United States Patent [19]

DeLong

[11] Patent Number: 4,680,041

[45] Date of Patent: Jul. 14, 1987

[54] METHOD FOR COOLING NORMALLY GASEOUS MATERIAL

[75] Inventor: Bradley W. DeLong, Bartlesville, Okla.

[73] Assignee: Phillips Petroleum Company, Bartlesville, Okla.

[21] Appl. No.: 814,455

[22] Filed: Dec. 30, 1985

[51] Int. Cl.[4] ..... F25J 3/00

[52] U.S. Cl. ..... 62/11; 62/23; 62/27; 62/31; 62/42

[58] Field of Search ..... 62/9, 11, 23, 24, 27, 62/28, 31, 32, 34, 42

[56] References Cited

U.S. PATENT DOCUMENTS

| | | | |
|---|---|---|---|
| 3,568,458 | 3/1971 | Hoffman | 62/28 |
| 3,581,510 | 6/1971 | Hughes | 62/11 |
| 3,581,511 | 6/1971 | Peck | 62/28 |
| 3,721,099 | 3/1973 | Forg et al. | 62/28 |
| 3,797,261 | 3/1974 | Juncker et al. | 62/28 |
| 3,929,438 | 12/1975 | Harder et al. | 62/9 |
| 4,033,735 | 7/1977 | Swenson | 62/9 |
| 4,235,613 | 11/1980 | Castoe et al. | 62/28 |
| 4,242,885 | 1/1981 | Quack et al. | 62/514 R |
| 4,331,461 | 5/1982 | Karbosky et al. | 62/28 |
| 4,417,449 | 11/1983 | Hegarty et al. | 62/28 |
| 4,430,103 | 2/1984 | Gray et al. | 62/28 |
| 4,451,275 | 5/1984 | Vines et al. | 62/28 |
| 4,488,890 | 12/1984 | Foerg et al. | 62/27 |

*Primary Examiner*—Ronald C. Capossela

*Attorney, Agent, or Firm*—Allen W. Richmond

[57] ABSTRACT

Normally gaseous feed materials, having a pressure significantly above ambient pressure, are cooled by passing the gaseous feed through an indirect heat exchange means, such as a plate-fin heat exchanger, passing a normally gaseous refrigerant, having a pressure substantially above ambient pressure, through the heat exchange means as a first stream in a concurrent direction with the feed stream, reducing the pressure of at least one second stream of refrigerant, preferably a plurality of second streams, as it exits the heat exchange means and passing the second stream of refrigerant, which has thus been reduced in pressure, through the heat exchange means in a countercurrent direction to the feed stream. This method can be employed for each cooling cycle of a method for cooling a natural gas stream to remove components therefrom and/or liquify the same.

19 Claims, 2 Drawing Figures

METHOD FOR COOLING NORMALLY GASEOUS MATERIAL

The present invention relates to the cooling of a normally gaseous material. In a more specific aspect, the present invention relates to the cryogenic cooling of a normally gaseous material. In a still more specific aspect, the present invention relates to a cascade-type method of cooling a normally gaseous material.

BACKGROUND

Normally gaseous materials are cooled for a variety of purposes. One major area involves the cooling of a normally gaseous material to separate all or some of the components of the normally gaseous material. For example, air is separated into its constituents by compressing the air to a pressure substantially above ambient pressure and, thereafter, passing the same through a series of cooling cycles. The components of the air are successively condensed and separated, the lowest boiling component being separated first, thereafter, intermediate boiling components and, finally, the highest boiling component. The cooling media may be one or more external refrigerants or a portion or portions of the cold gases or liquids produced in the process. Usually, the cooling medium is a combination of external refrigerants and cold gases or liquids produced in the process, since the use of the latter eliminates the need for additional external coolants as well as recovers some of the energy utilized in the system. Another process in which cooling of the normally gaseous material is utilized to separate components of the gas is in the processing of natural gas. While natural gas predominates in methane, such gases often contain contaminants such as nitrogen, as well as materials which are more valuable for other uses than the methane, which is most often utilized as a domestic or industrial fuel. Consequently, these contaminants and/or more valuable components are removed from the natural gas by the same type of cooling utilized in the separation of air into its components. For example, contaminants such as nitrogen, which can be included in a lean fuel utilized for in-plant purposes, or recovered as a product, helium, which may be recovered as a product, $C_2$, $C_3$, and $C_4$ hydrocarbons, which are valuable chemical feedstocks, and normally liquid $C_5$ and higher molecular weight hydrocarbons, which are valuable gasoline blending stocks as well as chemical feedstocks, are generally separated from the natural gas.

Another major reason for cooling normally gaseous materials is to liquify the gas or portions thereof for purposes of storage and transportation. Except for the fact that the gas must be cooled to a lower temperature to liquify the same, as opposed to separating the components thereof, the basic techniques utilized in liquifaction of a normally gaseous material are the same as those utilized in the separation of components of a normally gaseous material.

Cooling for the purposes of liquifying a normally gaseous material is also practiced in the processing of natural gas.

The processing of natural gas is illustrative of both the separation of components from a normally gaseous material, as well as the liquifaction of a portion thereof. A highly effective process of this type is illustrated and described in U.S. Pat. No. 4,430,103, which is incorporated herein by reference. While natural gas is usually at a pressure above ambient pressure as produced from an underground formation, in order to separate the components thereof and/or liquify the same it is generally necessary to compress the gas to a still higher pressure. For example the pressure of the feed gas to a natural gas processing system may vary anywhere between 100 and 5000 psia, the pressure will usually be between about 300 and 1500 psia, and in most instances between about 500 and 900 psia. In addition, it is necessary to compress the refrigerants utilized in the process. Obviously, such compression of the feed and the refrigerants requires substantial amounts of energy and it would be highly desirable to reduce these horsepower requirements of the system. As illustrated by FIG. 1 of the above-mentioned patent, the feed gas stream, at a pressure substantially above ambient pressure, is sequentially passed through three cooling cycles, usually comprising a propane cycle, an ethylene or ethane cycle and a methane cycle, and is, thereafter, reduced in pressure to ambient pressure for storage or transportation. During the course of cooling in the propane and ethane or ethylene cycles, $C_2$ and higher molecular weight hydrocarbons sequentially condense in accordance with their respective condensation temperatures. These components are removed, to the extent possible, by withdrawing the feed gas stream from the cooling sequence at appropriate temperatures, separating the liquid phase from the gas phase and returning the gas phase to the cooling sequence. The recovered liquid phase materials may then be separated into constituent streams by, for example, fractionation, as is also shown in FIG. 1 of the patent drawing. The feed gas stream will generally be in a liquid phase at a pressure somewhat below the original pressure but still substantially above ambient pressure as it leaves the ethane or ethylene cooling cycle. In order to reduce the pressure to ambient pressure for storage and/or transportation, the pressure is then reduced in an expansion cycle. Conveniently, the cold vapors flashed from the main gas stream in the pressure reduction cycle provide the refrigerant for the methane cooling cycle. Nitrogen is removed from the feed gas stream during the methane cooling cycle by withdrawing the feedgas stream from the cooling sequence and fractionating the stream, to produce a vapor phase enriched in nitrogen, or by a plurality of expansion stages or a combination of both, as shown in FIG. 1 of the patent. The cold vapors produced in the expansion cycle are utilized in the methane cooling cycle, as previously indicated, and are then compressed, cooled and returned to the main gas stream. While the temperature of the recycled methane will generally be approximately the same as the temperature of the main gas stream at the point which it is recombined, the pressure of the recycled methane will generally be below the pressure of the main gas stream. As a result, in order to compensate for this reduction of pressure, caused by recycling of the lower pressure methane, it is necessary that the initial pressure of the feed gas stream be higher. It would therefore be highly desirable to eliminate this reduction of pressure of the main gas stream at this point and thereby reduce the horsepower requirement necessary for initially compressing the feed gas stream.

It is also obvious, from FIG. 1 of the drawings of the patent, that each of the three cooling cycles includes a plurality of separate coolings stages, namely, three stages in the propane cycle, four stages in the ethane or ethlyene cycle and two stages in the methane cycle. Consequently, it is obvious that original equipment costs could be reduced, spaced and weight requirements could be reduced, making installation on a barge or the like convenient, and the design and ease of estimating the system could be reduced if a single heat exchanger could be utilized in place of the conventional, multiple heat exchange units. It is also to be observed that each of the cooling stages of the propane and ethylene or ethane cycles is generally a tube and shell type heat exchanger in which the feed gas stream passes through the tubes while the refrigerant is expanded into the shell of the exchanger. The shell of the exchanger also functions as a phase separator to separate liquid phase refrigerant from flashed refrigerant so that the liquid phase refrigerant may be advanced to the next successive cooling stage. This, of course, requires larger than normal heat exchangers. It is also to be observed that in order to reduce the pressure of the feed gas stream to ambient pressure during the expansion cycle and, at the same time, utilize flashed vapors as the refrigerant in the methane cycle, it is necessary to provide a vapor-liquid separator for each expansion stage. It would, therefore, be highly desirable if these vapor liquid separators could be eliminated and less complex and cumbersome equipment could be utilized in place of the tube and shell type heat exchangers utilized conventionally.

SUMMARY OF THE INVENTION

It is therefore an object of the present invention to provide an improved method for cooling normally gaseous materials which overcomes the above-mentioned and other problems of the prior art. Another object of the present invention is to provide an improved method for cooling normally gaseous materials which reduces initial equipment requirements and costs. A further object of the present invention is to provide an improved method for cooling normally gaseous materials which reduces space and weight requirements of the equipment. Another and further object of the present invention is to provide an improved method for cooling normally gaseous materials which simplifies the design thereof and thereby reduces the time and expense necessary for design and estimating. Yet another object of the present invention is to provide an improved method for cooling normally gaseous materials which reduces the input energy requirements thereof. A still further object of the present invention is to provide an improved method for cooling normally gaseous materials which reduces the horsepower requirements for initially compressing the gas. Another object of the present invention is to provide an improved method for cooling normally gaseous materials to separate preselected components therefrom. A further object of the present invention is to provide an improved method for cooling normally gaseous materials in order to liquify the same. Yet another object of the present invention is to provide an improved method for cooling normally gaseous materials in order to remove pre-selected components therefrom and liquify the same. Another and further object of the present invention is to provide an improved method for cooling normally gaseous materials in which phase distribution problems are reduced.

In accordance with the present invention, a normally gaseous feed, at a pressure substantially above ambient pressure, is cooled by passing the feed stream through an indirect heat exchange zone, passing a normally gaseous refrigerant, at an elevated pressure, through the heat exchange means as a first stream in a concurrent direction with the feed stream, reducing the pressure of at least one second stream of the refrigerant as it exits the heat exchange zone and passing the second stream of refrigerant, at the reduced pressure, through the heat exchange zone in indirect heat exchange with the feed stream and the first stream of refrigerant and in a countercurrent direction thereto. In a preferred embodiment, the refrigerant, as it exits the heat exchange means, is separated into a plurality of second refrigerant streams and the second refrigerant streams are reduced in pressure to different lower pressures.

In yet another embodiment, the above method is utilized in each of three sequential cooling cycles to separate preselected components from a natural gas stream and liquify the same.

BRIEF DESCRIPTION OF THE DRAWINGS

The present invention can be best understood by reference to the drawings wherein.

DESCRIPTION OF THE PREFERRED EMBODIMENTS

Since the processing of natural gas is illustrative of the cooling of a normally gaseous material, both to remove preselected components from the gas and to liquify at least a portion thereof and this application is a preferred embodiment of the present invention, the following description with reference to the drawings will be confined to the processing of natural gas. However, it is to be understood that the present invention is not confined to the processing of natural gas, nor to the separation of components from a gas or the liquification of a gas, but relates broadly to the cooling of a normally gaseous material in general and particularly the multi-stage cooling of a normally gaseous material.

Figure 1:
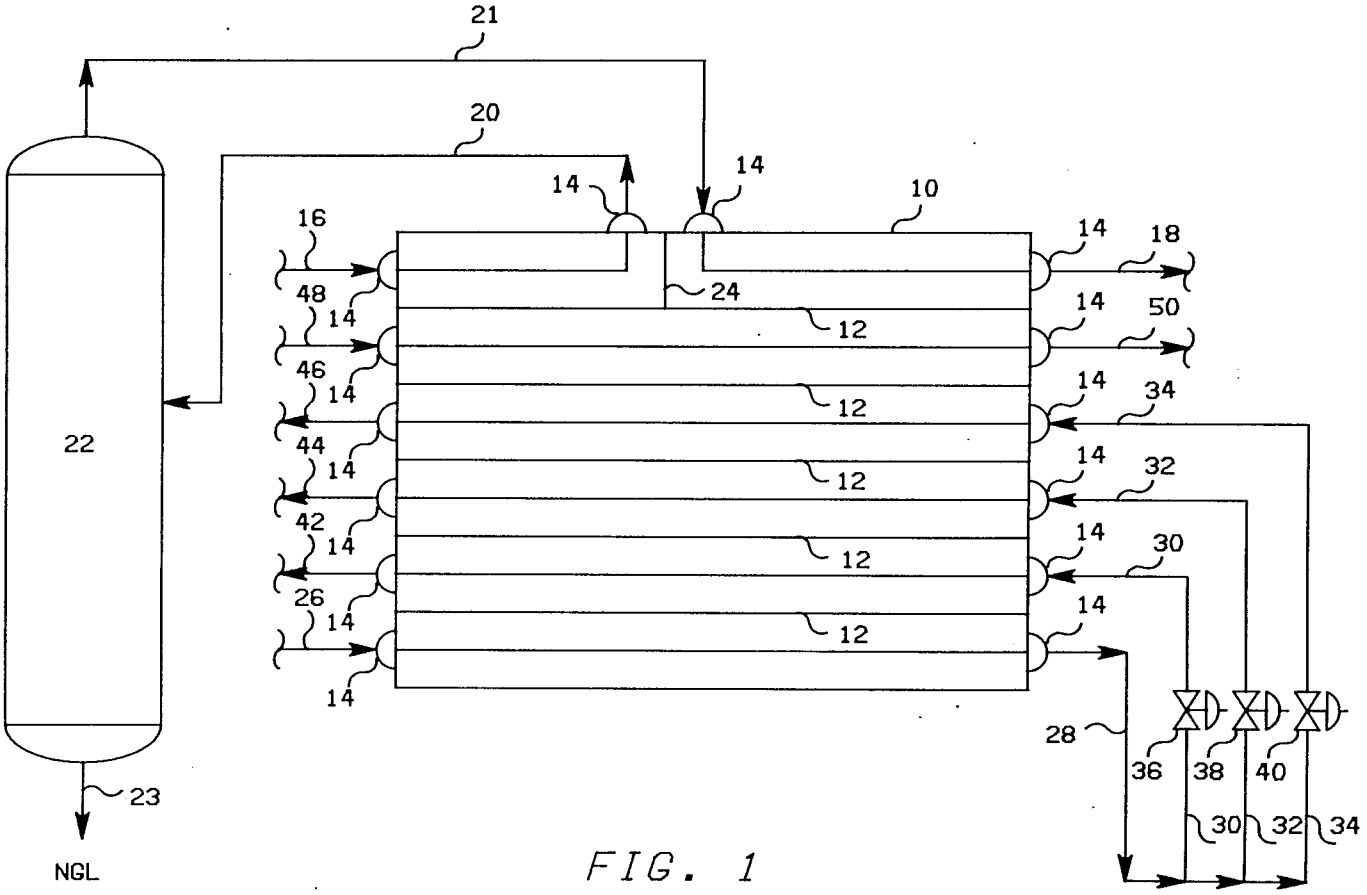
FIG. 1 is a schematic flow diagram illustrating equipment for the practice of the present invention.

FIG. 1 of the drawings schematically illustrates a side view of an indirect heat exchanger suitable for use in accordance with the present invention. Specifically, the heat exchanger illustrated is a brazed-aluminum-plate-fin heat exchanger. Such heat exchangers are described in *Perry's Chemical Engineers Handbook,* 6th Ed., 1984, McGraw-Hill at page 11–22. As described in this reference, plate-fin heat exchangers are made up of a stack of layers with each layer consisting of a corrugated fin between flat metal sheets sealed off on two sides by channels or bars to provide an extended surface area to form a fluid passage. Headers are formed the length of the open ends of the channel and fluid is flowed through the channel parallel to the corrugations. An exploded view of a typical plate-fin arrangement is shown in FIG. 11—11 at page 11–23 of the subject reference. This description and illustration are included herein by reference. In the schematic representation of FIG. 1 of the present application, a side view of a plate-fin heat exchanger 10 is shown in cross section. The heat exchanger 10 is divided into a plurality of flow channels by flat metal sheets 12. These flow channels contain corrugated fins, as shown in the Perry reference but which are not shown in the drawing. These flow channels or passages are referred to herein as cooling zones or stages (in conformity with the terminology utilized in describing a multi-stage cooling cycle in the prior art). The ends of the flow channels comprise headers 14 connected to fluid flow lines and into and out of which the fluid is flowed. For illustrative purposes only, flow through the passages is illustrated as a single flow line. However, it is to be understood that the fluid flowing through each passage fills the passage between the flat sheets which separate the passages and the space above and below the corrugated fin in each passage.

Figure 2:
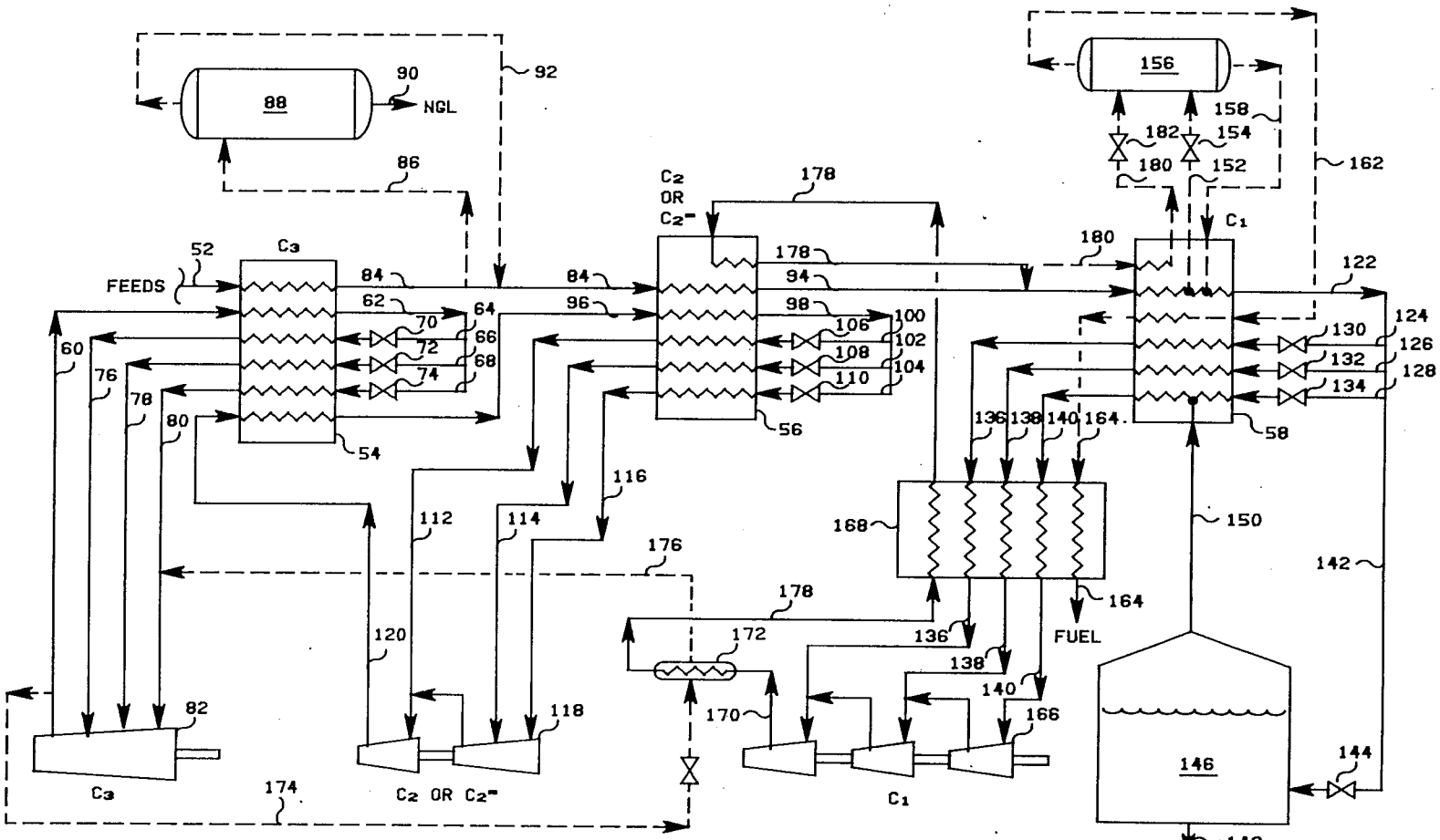
FIG. 2 is a schematic flow diagram illustrating the practice of the present invention in the processing of a natural gas stream.

Referring to FIG. 1, with reference to the use thereof as the ethane or ethylene cooling cycle of a multi-cycle system for cooling a natural gas for the purpose of removing preselected components thereof and/or liquifying the same, the feed gas is introduced through line 16 and exits through line 18. To the extent that components of the natural gas are to be separated during the course of the cooling, the natural gas feed stream may be withdrawn from the cooling sequence through line 20 introduced into a vapor-liquid separator 22 and therein separated into a vapor phase and a liquid phase. The latter is a natural gas liquids stream (enriched in $C_2$ and higher molecular weight hydrocarbons) which is discharged through line 23. The separated vapors are discharged through line 21 and returned to the cooling zone of heat exchanger 10. It is to be understood that the withdrawal and separation will be performed at any point in a cooling sequence at any appropriate temperature at which the component or components to be removed are condensed at the existing pressure of the gas stream. Such withdrawal from the cooling sequence as the gas passes through the heat exchanger can be simply performed by dividing a single flow passage by means of a vertically disposed plate or sheet 24 extending all the way across the flow channel and providing headers 14 at the end of the divided channel or flow passage for the withdrawal and reintroduction of the gas stream. A first stream of liquified refrigerant, either ethane or ethlene, is introduced through line 26 and exits through line 28. For illustrative purposes, this stream is referred to as a first stream of ethylene refrigerant. As the first stream of refrigerant exits heat exchanger 10, it is divided into a plurality of second refrigerant streams, 30, 32 and 34, respectively. For certain purposes other than the separation and liquifaction of natural gas, a single second stream of refrigerant will suffice. However, for the processing of the natural gas and for illustrative purposes, three separate second streams of refrigerant are shown. Adjacent the input ends of three separate cooling passages or zones of heat exchanger 10, the pressure of the refrigerant streams are reduced in pressure by passing the same through expansion valves 36, 38 and 40, respectively. In the illustrative case, these expansion valves 36, 38 and 40 reduce the original pressure of the first stream of refrigerant to approxiamtely ½, 1/5 and 1/10, respectively. The pressure reductions to be selected can be readily determined by one skilled in the art to produce the degree of cooling desire or necessary. In the present instance, as will be obvious from the example hereinafter presented, the pressure reduction is such that the refrigerant passing through exchanger 10 from lines 30 and 32 are subcooled liquids, whereas the portion of the refrigerant passing through heat exchanger 10 from line 34 is a two-phase, vapor-liquid stream. By this selection of pressure reductions, phase distribution problems are reduced. Second refrigerant streams 30, 32 and 34 are discharged from heat exchanger 10 through lines 42,44 and 46. As will be pointed out with reference to FIG. 2 of the drawings, the refrigerant from lines 42, 44 and 46 is passed to appropriate compressors which recompress the refrigerant to approximately its original pressure and recycle the same back to input line 26 of heat exchanger 10. A recycle methane stream, which will be referred to in greater detail with reference to FIG. 2, is introduced to heat exchanger 10 through line 48 and exits through line 50. While FIG. 1 illustrates a single flow passage for each stream of fluid passing through heat exchanger 10, it is to be understood that a single flow passage may be divided into several sections, as by divider 24 of FIG. 1, or a single stream of fluid may be passed through a plurality of flow passages or parts thereof as appropriate, to attain the desired degree of cooling for the purpose for which the method is utilized. It is also to be observed, from FIG. 1, that the stream or streams to be cooled are flowed through heat exchanger 10 in a direction concurrent with the first stream of refrigerant while the second streams of refrigerant are flowed through heat exchanger 10 in a direction countercurrent to the stream or streams to be cooled an the first stream of refrigerant. However, as will be apparent from the example hereinafter presented, the arrangement (that is the relation of the various streams to one another through the flow passages) is generally immaterial since the temperatures of all fluids at a given end of heat exchanger 10 are approximately the same, but appropriate heat exchange areas and pressure reductions are selected for a given cooling method.

FIG. 2 of the drawings illustrates a preferred embodiment of the present invention in which a natural gas is cooled, in three, multi-stage cycles, utilizing propane, ehtylene and methane as refrigerants, to liquify the gas. It should be clearly noted that each cooling cycle utilizes a single heat exchanger as described with reference to FIG. 1, as opposed to the plurality of individual heat exchangers conventionally utilized in practicing this method. Also illustrated in FIG. 2 are alternative techniques for separating components of the natural gas stream during the course of the liquifaction process.

In accordance with FIG. 2 a natural gas feed stream, compressed to an appropriate pressure substantially above ambient pressure, is introduced to the system through line 52. As the gas passes through the system, it is sequentially cooled through a propane cooling cycle 54, an ethane or ethylene cycle 56 and a methane cooling cycle 58. As represented by individual, single indirect heat exchangers 54, 56 and 58, respectively. Heat exchangers 54, 56 and 58, as previously indicated, are of the structure previously described with respect to FIG. 1 and employ the method previously described with relation to FIG. 1.

In the propane cooling cycle 54 a first stream of liquified propane refrigerant is introduced to heat exchanger 54 through line 60, flows in indirect heat exchange through heat exchanger 54 and in a direction concurrent with the flow of feed through heat exchanger 54. The first stream of propane refrigerant exits heat exchanger 54 through line 62. The first stream of propane refrigerant is then separated into three refrigerant streams 64, 66 and 68, respectively. The second streams of propane refrigerants 64, 66 and 68 are passed through expansion valves 70, 72 and 74, respectively, where they are reduced in pressure to three successively lower pressures. The second streams of propane refrigerant, which have thus been reduced in pressure, are then flowed through heat exchanger 54 in indirect heat exchange with the natural gas feed stream and the first stream of propane refrigerant and in a direction countercurrent thereto. The second streams of propane refrigerant 64, 66 and 68 then exit heat exchanger 54 through lines 76, 78 and 80, respectively.

The reduced pressure second streams of propane refrigerant are then passed through a single or multistage compressor means 82 where the refrigerant is recompressed to essentially its original pressure and returned to heat exchanger 54 through line 60.

The natural gas feed stream exits heat exchanger 54 through line 84. If one or more preselected components of the natural gas, for example, normally gaseous $C_2$, $C_3$ and $C_4$ or a normally liquid stream, for example, $C_5$ and higher molecular weight hydrocarbons or natural gas liquids, are to be separated from the natural gas feed stream, such separation may be carried out at one or more points along the cooling sequence. These points are selected on the basis of the temperature at which the preselected component or components condense. Consequently, such removal can be carried out as the gas flows through one or more of the heat exchangers 54, 56 and 58, as illustrated in FIG. 1, or between heat exchange cycles 54, 56 and 58, as shown in FIG. 2 of the drawings. Multiple point withdrawal and separation of condensed components can be carried out, as the natural gas flows through the heat exchangers illustrated in U.S. Pat. No. 4,430,103. It should be recognized at this point that such withdrawal and reintroduction of the feed stream is substantially more complex and costly utilizing heat exchangers, as illustrated in U.S. Pat. No. 4,430,103, but is quite simple and inexpensive in the construction of a heat exchanger as shown in FIG. 1 of the drawings of the present application.

As illustrated in FIG. 2 of the drawings of the present invention, the natural gas feed stream may be withdrawn through line 86, passed to vapor-liquid separator 88 and the condensed liquid, in the case illustrated natural gas liquids, discharged through line 90. The separated liquids may, as previously indicated, be normally gaseous components, such as $C_2$, $C_3$ and $C_4$ hydrocarbons as well as natural gas liquids comprising $C_5$ and higher molecular weight hydrocarbons. In this case, the condensed liquids could be separated into individual component streams as illustrated in U.S. Pat. No. 4,430,103. The separated vapor phase from separator 88 is passed through line 92 and returned to the cooling sequence.

The natural gas stream is introduced into the ethane or ethylene cooling cycle 56 through line 84 and exits heat exchanger 56 through line 94. The natural gas feed stream is cooled in heat exchanger 56 by indirect heat exchange with liquified ethane or ethylene introduced through line 96. The first stream of ethane or ethylene refrigerant exits heat exchanger 56 through line 98 after passing in indirect heat exchange with the natural gas feed stream and in a direction concurrent therewith. The first stream of ethane or ethylene refrigerant is then split into second streams 100, 102 and 104. The second streams of ethane or ethylene refrigerant through lines 100, 102 and 104 are reduced in pressure by passage through expansion valves 106, 108 and 110, respectively. As in the propane cooling cycle, the pressure reductions are successively lower through expansion valves 110, 108 and 106, respectively. The second streams of ethane or ethylene refrigerant exit heat exchanger 56 through lines 112, 114 and 116 and are recompressed in compressor means 118. In order to reduce the temperature of the recompressed ethane or ethylene refrigerant, the recompressed refrigerant is passed through line 120 thence through heat exchanger 54 of the propane cycle in indirect heat exchange with the second streams of propane and countercurrent thereto, concurrently with the natural gas feed stream, the first propane stream. The thus recompressed and cooled liquified ethane or ethylene is then passed to ethane cooling cycle 56 through line 96.

The natural gas feed stream from line 94 is then passed through indirect heat exchanger 58 of the methane cooling cycle. This first stream of methane refrigerant exits heat exchanger 58 through line 122. Portions of the natural gas feed stream, representing the first methane refrigerant stream, are split from main stream into second methane refrigerant streams 124, 126 and 128, respectively. The second streams of methane refrigerant 124, 126 and 128 are reduced in pressure by passage through expansion valves 130, 132 and 134, respectively. As in the previous cooling cycles, passage through expansion valves 130, 132 and 134 reduces the pressure of the second streams of methane refrigerant to successively lower pressures. The second streams of methane refrigerant exit heat exchanger 58 through lines 136, 138 and 140, respectively. The major portion or remainder of the natural gas feed stream passes through line 142 and thence through expansion valve 144 to storage unit or transport unit 146. Liquified natural gas from storage unit 146 can be withdrawn through line 148. Vapors flashed from the gas in expanding the same into the storage unit are withdrawn from the storage unit through line 150 and added to the second stream of methane refrigerant passing through heat exchanger 58 via lines 128 and 140.

If nitrogen is to be removed from the natural gas stream, this is most conveniently carried out by withdrawing the natural gas stream from the cooling sequence in or near heat exchanger 58. Specifically, the natural gas feed stream may be withdrawn through line 152, passed through expansion valve 154 and separated into a vapor phase and a liquid phase in vapor-liquid separator 156. The natural gas stream may also be passed to a nitrogen column or fractionation column and separated into a vapor phase and a liquid phase by fractionation. The liquid phase comprises a rich natural gas stream of reduced nitrogen content, which is returned to the cooling sequence through line 158. The vapor phase, separated in separator 156, is discharged through line 162, passed through heat exchanger 58 in indirect heat exchange with the main feed stream and in a direction countercurrent thereto and exits heat exchanger 58, through line 164. In passing through heat exchanger 58, a portion of the cooling energy present in stream 162 is utilized in cooling the main gas stream. The vapor phase passing through line 162 is enriched in nitrogen but contains substantial amounts of methane. Accordingly, this stream is not suitable as a pipeline gas, for domestic or industrial heating purposes, but is suitable as a fuel for in-plant purposes. The second streams of methane refrigerant passing through lines 136, 138 and 140 are recompressed in compressor means 166 and ultimately returned to the natural gas feed stream as a recycle. In order to effect further economies and utilize the cooling energy of the second streams of methane refrigerant and the fuel gas stream, these streams are passed through indirect heat exchanger 168 in order to aid in cooling the recycle methane stream. Preferably, the recompressed, recycle methane stream passes through line 170 and thence through methane chiller or heat exchanger 172. Refrigerant for cooling the recycle stream in heat exchanger 172 may be a portion of the propane refrigerant withdrawn through line 174, returned to the propane refrigerant through line 176 and combined with one of the second streams of propane refrigerant through line 180, for recompression. The recycle methane from heat exchanger 172 passes, via line 178, through heat exchanger 168, where it is further cooled, and thence through heat exchanger 56 and the ethane or ethylene cycle and the ethane or ethylene is still further cooled the same. After passage through heat exchanger 56, the recycle methane is recombined with the natural gas feed stream at an appropriate point downstream of heat exchanger 56. This technique of cooling the recycle methane stream in the ethane or ethylene cooling cycle, separately from the natural gas feed stream, and, thereafter, recombining the recycle stream with the natural gas feed stream is another distinct advantage of the present invention. As is to be seen from U.S. Pat. No. 4,430,103, the conventional method of recycling methane to the main gas stream adds the methane to the main gas stream upstream of the last stage of ethane or ethylene heat exchange. Since the recycle stream is substantially lower in pressure than the main gas stream at this point, the main gas stream is reduced in pressure prior to flowing through the ethane or ethylene cooling stage. By separately passing the recycle and main gas stream through the ethane or ethylene stage, significant reductions in the pressure to which the natural gas feed stream is initially compressed and the horsepower requirements of the system are thus reduced. To the extent that nitrogen is to be removed from the recycle stream, the recycle gas stream may be passed through line 180, further cooled in heat exchanger 58, reduced in pressure through expansion valve 182 and thence separated along with the main gas stream in vapor-liquid separator 156.

A calculated heat and pressure balance for the cooling system of FIG. 1 utilizing a natural gas stream as the feed stream and ethylene as the refrigerant, which would be typical of the ethylene cooling cycle 56 of FIG. 2, is set forth in the following Table.

TABLE

| | 16 | 48 | 46 | 44 | 42 | 26 | 18 | 50 | 28 | 30 | 30 | 32 | 32 | 34 | 34 |
|---|---|---|---|---|---|---|---|---|---|---|---|---|---|---|---|
| Temp. °F. | −28 | −28 | −32 | −32 | −32 | −28 | −137 | −137 | −137 | −137 | −137 | −137 | −137 | −137 | −141 |
| Press. psia | 612 | 535 | 19 | 48 | 118 | 266 | 592 | 530 | 261 | 261 | 123 | 261 | 53 | 261 | 34 |

While specific materials, conditions of operation, modes of operation and equipment have been referred to herein, it is to be recognized that these and other specific recitals are for illustrative purposes and to set forth the best mode only and are not to be considered limiting.

That which is claimed:

1. In a method for cooling a normally-gaseous feed stream, having a pressure significantly above ambient pressure, comprising:

(a) passing said feed stream through an indirect heat exchange means;

(b) passing a normally-gaseous refrigerant, having a pressure substantially above ambient pressure, through said heat exchange means, as a first stream, in a concurrent direction with said feed stream;

(c) dividing said first stream of refrigerant into at least two second streams of refrigerant, as it exits said heat exchange means;

(d) reducing the pressure of each of said second streams of refrigerant to different, lower pressures; and (e) separately passing said second streams of refrigerant, which have thus been reduced in pressure, through said heat exchange means in indirect heat exchange with said feed stream and said first stream of refrigerant and in a countercurrent direction thereto.

2. A method in accordance with claim 1 wherein the first stream of refrigerant is thus divided into three second streams of refrigerant and each of said three second streams of refrigerant are thus reduced to different, lower pressures.

3. A method in accordance with claim 1 wherein the gaseous feed is natural gas and the refrigerant is propane.

4. A method in accordance with claim 1 wherein the gaseous feed is natural gas and the refrigerant is selected from the group consisting of ethane and ehtylene.

5. A method in accordance with claim 1 wherein the gaseous feed is natural gas and the refrigerant is methane.

6. A method for sequentially cooling a normally-gaseous feed stream, having a pressure significantly above ambient pressure, comprising:

(a) passing said feed stream through a first, indirect heat exchange means;

(b) passing a first, low-boiling, normally-gaseous refrigerant, having a pressure substantially above ambient pressure, through said first heat exchange means, as a first stream, in a concurrent direction with said feed stream;

(c) reducing the pressure of at least one second stream of said first refrigerant, as it exits said first heat exchange means;

(d) passing said second stream of said first refrigerant, which has thus been reduced in pressure, through said first heat exchange means, in indirect heat exchange with said feed stream and in a countercurrent direction thereto, in a first cooling cycle;

(e) thereafter, passing said feed stream through a second, indirect heat exchange means and repeating steps (b) through (d) with a second, intermediate-boiling, normally-gaseous refrigerant, having a pressure substantially above ambient pressure, in a second cooling cycle; and (f) thereafter, passing said feed stream through a third, indirect heat exchange means and repeating steps (b) through (d) with a third, high-boiling, normally-gaseous refrigerant, having a pressure substantially above ambient pressure, in a third cooling cycle.

7. A method in accordance with claim 6 wherein the feed stream is natural gas, the first refrigerant is propane, the second refrigerant is selected from the group consisting of ethane and ethylene and the third refrigerant is methane.

8. A method in accordance with claim 7 wherein the third refrigerant is a portion of the feed stream withdrawn as it exits the third cooling cycle.

9. A method in accordance with claim 6 wherein the feed stream predominates in methane and contains significant amounts of at least one $C_2$ and higher molecular weight hydrocarbon, the feed stream is withdrawin from the cooling sequence, at at least one point at which the temperature of said feed stream is sufficient to liquify at least one said $C_2$ and higher molecular weight hydrocarbons, the thus withdrawn feed stream is separated into a liquid phase, comprising said at least one of said $C_2$ and higher molecular hydrocarbons, and a vapor phase, comprising the remainder of said feed stream, and said vapor phase is returned to said cooling sequence.

10. A method in accordance with claim 6 wherein the feed stream predominates in methane and contains a significant amount of $N_2$, said feed stream is substantially liquified, as it exits the second cooling cycle, said feed stream is withdrawn from the cooling sequence at a point downstream of said second cooling cycle, the thus withdrawn feed stream is reduced in pressure to produce a vapor phase, enriched in nitrogen, and a liquid phase, comprising the remainder of said feed stream, said feed stream, which has thus been reduced in pressure, is separated into said vapor phase and said liquid phase and said liquid phase is returned to said cooling sequence.

11. A methhod in accordance with claim 10 wherein the thus separated vapor phase is passed through the third heat exchange zone in indirect heat exchange with the feed stream and in a countercurrent direction thereto.

12. A method in accordance with claim 6 wherein the first, second and third refrigerants are recompressed, in at least one compression stage of first, second and third compression cycles, respectively, to approximately their original pressure after they exit the first, second and third cooling cycles, respectively, the thus recompressed first, second and third refrigerants are recycled to said first, second and third cooling cycles, respectively, to thus provide essentially closed refrigerant cycles and some heat of recompression is removed by indirect heat exchange between the compressor discharge streams and air or cooling water.

13. A method in accordance with claim 12 wherein the third refrigerant is passed through a fourth heat exchange means, as a third stream, in indirect heat with said third refrigerant, as a second stream, after said third stream has thus passed through the third heat exchange means and before said first stream has thus been recompressed, said third stream is passed through the second heat exchange zone, in a concurrent direction with said feed stream, and, at least part of said third stream is returned to the cooling sequence.

14. A method in accordance with claim 13 wherein all of the third stream of third refrigerant is thus returned to the cooling sequence after the feed stream exits the second heat exchange means and before said feed stream enters the third heat exchange means.

15. A method in accordance with claim 13 wherein the third stream of third refrigerant is withdrawn from the cooling sequence at a point downstream of the second heat exchange means, the thus withdrawn third stream of third refrigerant is reduced in pressure to produce a vapor phase, enriched in nitrogen, and a liquid phase, comprising the remainder of said third stream of third refrigerant, said third stream of third refrigerant, which has thus been reduced in pressure, is separated into said vapor phase and said liquid phase, said vapor phase is passed through the fourth heat exchange means, in indirect heat exchange with said third stream of third refrigerant and in a direction countercurrent thereto, and said liquid phase is returned to the cooling sequence by combining the same with the feed stream.

16. A method in accordance with claim 13 wherein the third stream of third refrigerant is passed through the third heat exchange means, in a direction concurrent with the feed stream, said third stream a third refrigerant is thus withdrawn from the cooling sequence, as it thus passes through said third heat exchange means, said feed stream is withdrawn from said cooling sequence, as it thus passes through said third heat exchange means, the thus withdrawn third stream of third refrigerant is thus reduced in pressure and the thus withdrawn feed stream is reduced in pressure, to produce a vapor phase, enriched in nitrogen and comprising a portion of said third stream, of third refrigerant and a portion of said feed stream and a liquid phase, comprising the remainder of said third stream of third refrigerant and the remainder of said feed stream, said third stream of third refrigerant and said feed stream, which have thus been reduced in pressure, are separated into said vapor phase and said liquid phase, said liquid phase is returned to said cooling sequence, as the feed stream, as it thus passes through said third heat exchange means, and said vapor phase is passed through said third heat exchange means, in indirect heat exchange with said feed stream and in a direction countercurrent thereto.

17. A method in accordance with claim 16 wherein the vapor phase is passed through the fourth heat exchange means, in indirect heat exchange with the third stream of third refrigerant and in a direction countercurrent thereto.

18. A method in accordance with claim 12 wherein a portion of the first refrigerant is withdrawn from the thus recompressed first refrigerant, the thus withdrawn portion of said first refrigerant is passed in indirect heat exchange with the thus recompressed third refrigerant, said withdrawn portion of said first refrigerant is recombined with said first refrigerant, after said first refrigerant has thus passed through the first heat exchange and before it has thus been recompressed, and the thus recompressed second refrigerant is passed through the first heat exchange means, in a direction concurrent with said feed stream, prior to thus passing said second refrigerant through the second heat exchange means.

19. A method in accordance with claim 6 wherein the third refrigerant is a portion of the feed stream, as it exits the third cooling cycle.

* * * * *